US006024548A

United States Patent [19]

Bushnell

[11] Patent Number: 6,024,548

[45] Date of Patent: Feb. 15, 2000

[54] MOTOR BEARING LUBRICATION IN ROTARY COMPRESSORS

[75] Inventor: Paul J. Bushnell, Syracuse, N.Y.

[73] Assignee: Carrier Corporation, Syracuse, N.Y.

[21] Appl. No.: 08/986,454

[22] Filed: Dec. 8, 1997

[51] Int. Cl.[7] ..... F01C 21/04

[52] U.S. Cl. ..... 418/94; 418/63; 184/6.16; 184/6.18

[58] Field of Search ..... 418/94, 63; 184/6.16, 184/6.18

[56] References Cited

U.S. PATENT DOCUMENTS 4,629,403 12/1986 Wood .
4,877,381 10/1989 Johnson et al. .
4,902,205 2/1990 DaCosta et al. ..... 418/94 X
5,006,051 4/1991 Hattori ..... 418/94 X
5,586,876 12/1996 Yasnnascoli et al. ..... 418/94 X
5,685,703 11/1997 Fukuoka et al. .
5,823,755 10/1998 Wilson et al. ..... 418/63 X
5,842,420 12/1998 Khoo et al. ..... 418/94 X

*Primary Examiner*—Hoang Nguyen

[57] ABSTRACT

An oil groove is formed in the shaft journal facing the upper bearing land of a high side rotary compressor and is located relative to the eccentric such that the groove is not located in a high loading region of the shaft journal.

2 Claims, 3 Drawing Sheets

MOTOR BEARING LUBRICATION IN ROTARY COMPRESSORS

BACKGROUND OF THE INVENTION

In vertical, high side rolling piston or sliding vane compressors, the shaft is supported in an upper or motor end bearing. Within the bearing, the shaft has two journals separated by an annulus. Conventionally, the motor end bearing has an internal oil groove formed therein which runs the entire bearing length. Running a compressor with a conventional oil groove to determine the maximum speed before failure resulted in failure due to upper bearing land failure. The failure was due to the dynamic loading from the rotor counterweights which directed continuous load over the complete shaft revolution causing disrupted film pressure as the point load of the upper bearing land passed through the internal oil groove on the motor bearing.

SUMMARY OF THE INVENTION

The present invention maintains the oil film pressure of the upper land of a motor bearing, through the complete revolution of the shaft journal, by connecting the internal oil groove of the lower land via the oil annulus to an external groove in the shaft journal facing the upper land of the bearing.

It is an object of this invention to permit high speed compressors to operate at high speed without damaging the upper bearing land due to the dynamic loads that dominate at high speed.

It is another object of this invention to maintain the oil film pressure of the upper land of a motor bearing through a complete revolution of the journal. These objects, and others as will become apparent hereinafter, are accomplished by the present invention.

Basically, an oil groove is formed in the shaft journal facing the upper bearing land and is located 90° to 270° ahead of the maximum radial extent of the eccentric in the direction of rotation.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
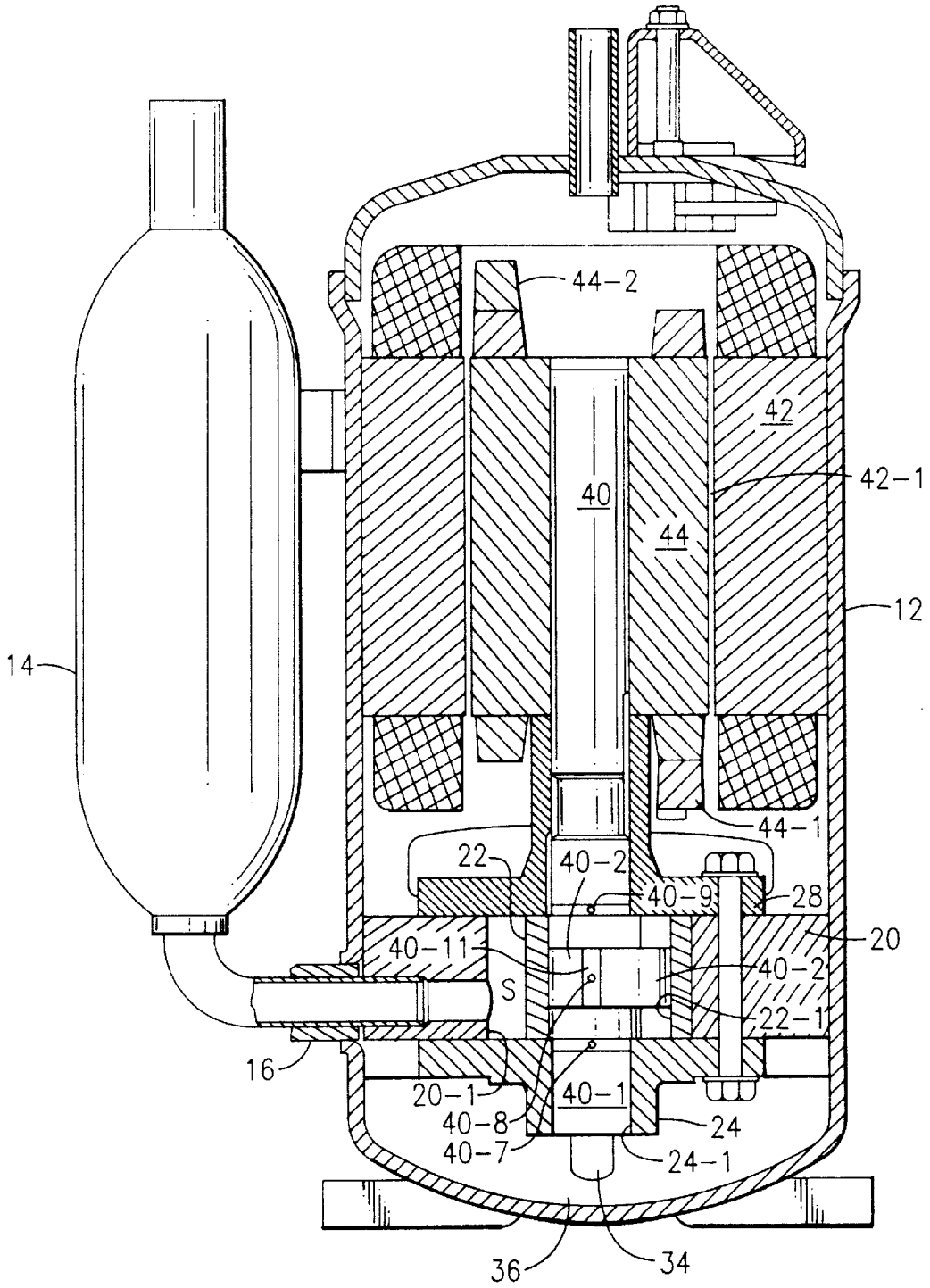
FIG. 1 is a partially sectioned view of a vertical, high side rolling piston compressor employing the present invention.
Figure 3:
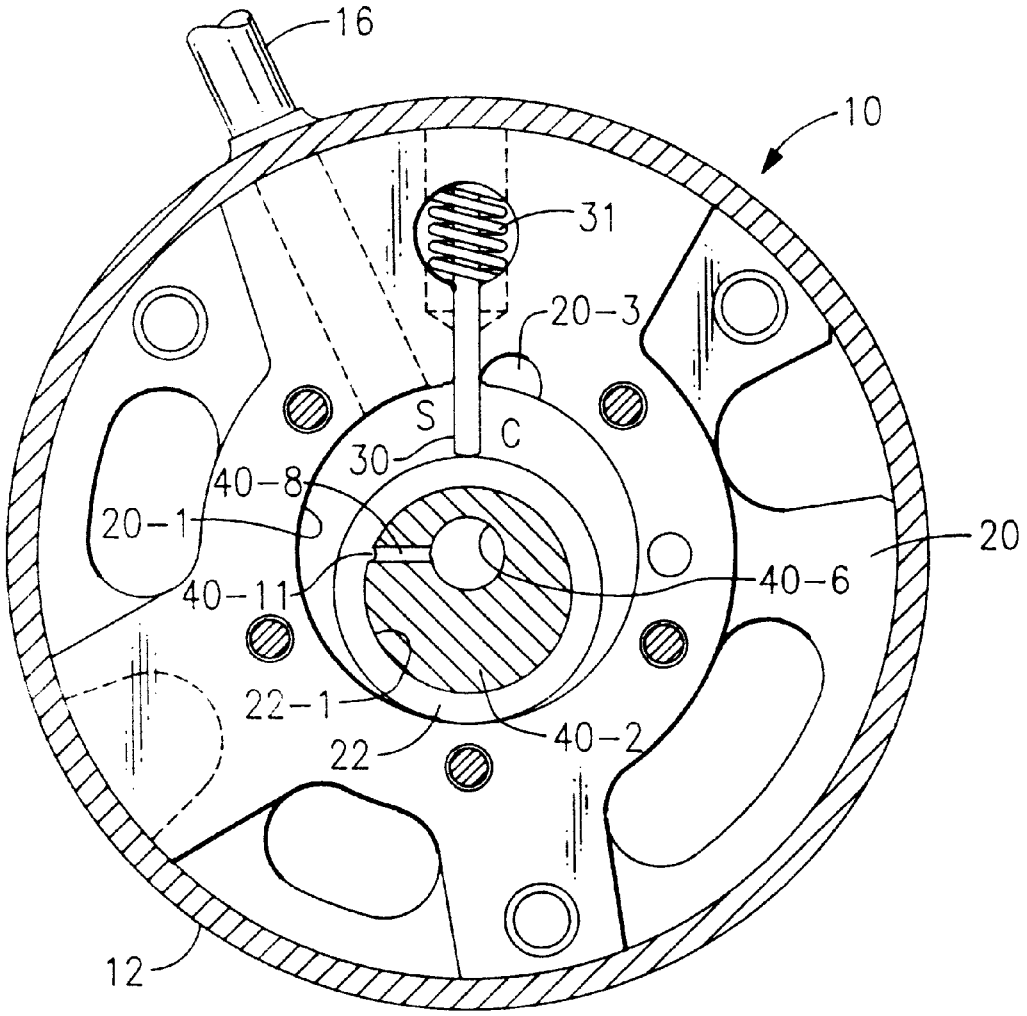
FIG. 3 is a sectional view through the lubrication structure of the eccentric.

In FIGS. 1 and 3, the numeral 10 generally designates a vertical, high side rolling piston compressor. The numeral 12 generally designates the shell or casing. Suction tube 16 is sealed to shell 12 and provides fluid communication between suction accumulator 14, which is connected to the evaporator (not illustrated), and suction chamber S. Suction chamber S is defined by bore 20-1 in cylinder 20, piston 22, pump end bearing 24 and motor end bearing 28.

Figure 2:
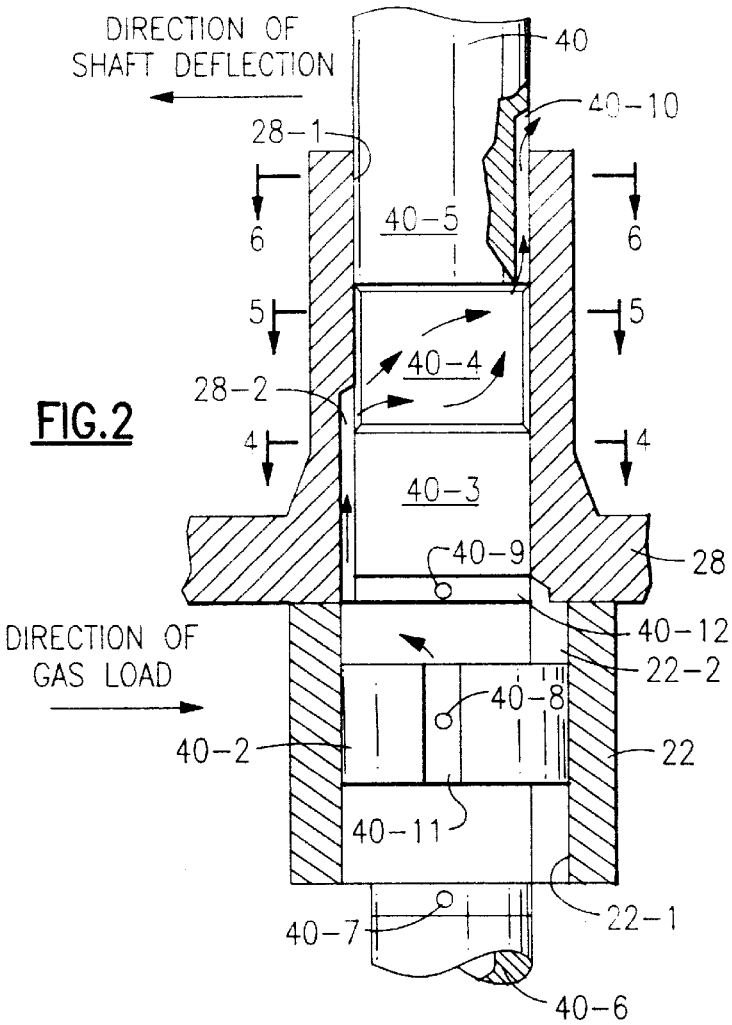
FIG. 2 is a partially sectioned view of a portion of FIG. 1.
Figure 4:
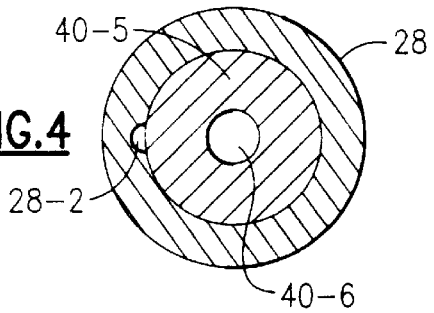
FIG. 4 is a sectional view taken along line 4—4 of FIG. 2.
Figure 5:
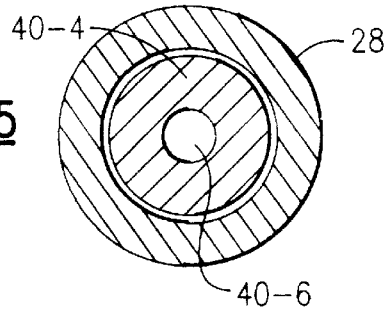
FIG. 5 is a sectional view taken along line 5—5 of FIG. 2.
Figure 6:
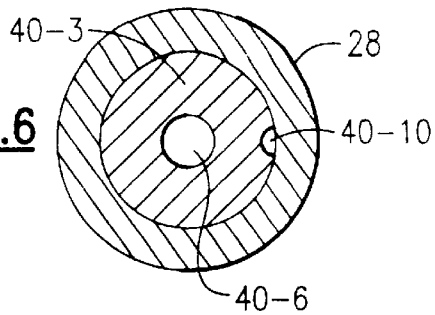
FIG. 6 is a sectional view taken along line 6—6 of FIG. 2.

Eccentric shaft 40 includes a portion 40-1 supportingly received in bore 24-1 of pump end bearing 24 and eccentric 40-2 which is received in bore 22-1 of piston 22. As is best shown in FIG. 2, eccentric shaft 40 further includes lower journal 40-3, oil annulus 40-4 defined by a recessed area in shaft 40 and upper journal 40-5 supportingly received in bore 28-1 of motor end bearing 28. Oil pick up tube 34 functions as a centrifugal pump and extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define an electric motor. Counterweights 44-1 and 44-2 are secured to rotor 44 to provide dynamic balancing.

In operation, rotor 44 and eccentric shaft 40 rotate as a unit and eccentric 40-2 causes movement of piston 22. Oil from sump 36 is drawn through oil pick up tube 34, which acts as a centrifugal pump, and passes into bore 40-6. The pumping action will be dependent upon the rotational speed of shaft 40. Oil delivered to bore 40-6 is able to flow into a series of radially extending passages, 40-7 in portion 40-1, 40-8 in eccentric 40-2 and 40-9 in journal 40-3 to lubricate bearing 24, piston 22, and bearing 28, respectively.

The structure and operation described so far is generally conventional and oil delivered to passages 40-7, 40-8, and 40-9 by the centrifugal pump structure tends to combine, with at least a portion of the oil tending to flow upwardly. The present invention provides axially extending oil groove 28-2 in the wall of bore 28-1. Groove 28-2 extends the full length of journal 40-3 plus a portion of the axial extent of oil annulus 40-4 but is shorter than a conventional groove in that it is not coextensive with journal 40-5. The present invention adds oil groove 40-10 in shaft 40. Oil groove 40-10 extends from oil annulus 40-4 the full length of journal 40-5 and past the end of bearing 28.

The coaction of piston 22, bore 20-1 and the vane 30 which is biased into contact with piston 22 by spring 31 results in the compression of a trapped volume of gas which provides a gas load through the piston 22 to the eccentric 40-2 and thereby to the shaft 40. The gas load increases in intensity and advances in its rotary position as the compression process continues. The gas load tends to cant shaft 40 with the direction of deflection being opposite that of the gas load and having its greatest effect in the upper land of bearing 28 which faces journal 40-5. This loading is cyclic with the compression cycle but it is balanced by counterweights 44-1 and 44-2 which provide a speed dependent constant loading. As the counterweights are offset 180°, the lead end counterweight 44-2 is pulling and bending shaft 40 such that the upper land of bearing 28 sees a fully orbiting load.

Oil supplied to passage 40-8 flows into axial groove 40-11 and at least a portion flows upwardly into the annular recess 22-2 located in piston 22 above eccentric 40-2. Oil supplied to passage 40-9 passes into annular recess 40-12 which is in fluid communication with both annular recess 22-2 and oil groove 28-2. Accordingly, flow from passage 40-8 passes through groove 40-11, annular recess 22-2 into annular recess 40-12 where it combines with oil supplied to passage 40-9. The oil under pressure due to the centrifugal pumping effect supplying the oil passes into groove 28-2 and lubricates the surface of journal 40-3 as it passes groove 28-2 during each rotation. Oil passing through groove 28-2 passes into oil annulus 40-4. Oil flows from oil annulus 40-4 into groove 40-10 in shaft 40 providing lubrication to journal 40-5. The dynamic load of rotor 44 pulls shaft 40 radially towards the lead end counterweight 44-2. However, it will be noted that eccentric 40-2 which drives piston 22 is fixed with respect to groove 40-10 so that the compression process loading dictated by eccentric 40-2 which drives piston 22 can be adjusted relative to the location of groove 40-10. By locating groove 40-10, 90°–270° ahead of the maximum radial extent of eccentric 40-2 in the direction of rotation avoids lubrication failure of the upper land of bearing 28. In a preferred embodiment groove 40-10 is 180° ahead of the maximum radial extent of eccentric 40-2.

Although a preferred embodiment of the present invention has been illustrated and described, other changes will occur to those skilled in the art. It is therefore intended that the scope of the present invention is to be limited only by the scope of the appended claims.

What is claimed is:

1. In a high side rotary compressor having a shell with a first end and a second end, a cylinder having a bore containing pump structure including a piston coacting with said cylinder, said cylinder being fixedly located in said shell near said first end and defining with said first end a chamber, an oil sump located at the bottom of said chamber, a first bearing underlying said bore and secured to said cylinder and extending towards said first end, a second bearing having a bore and secured to said cylinder and overlying said bore in said cylinder and extending towards said second end, a motor including a rotor and a stator, a shaft supported by said first and second bearings and including an eccentric operatively connected to said piston, means for providing lubrication comprising:

an axial bore in said shaft;

an oil pickup tube extending from said sump to said axial bore;

a plurality of oil distribution passages fluidly connected to said axial bore for delivering oil at axially spaced locations on said shaft;

said shaft having first and second journals spaced by a recessed area defining an oil annulus with said journals being located in and supported by said bore of said second bearing;

an axially extending groove in said bore of said second bearing coextensive with said first one of said journals which is located nearer said cylinder and a portion of said oil annulus;

an axially extending groove in said shaft extending from said oil annulus the full length of said second journal and beyond said second bearing; and at least one of said oil distribution passages providing pressurized oil from said sump to said axially extending groove in said bore of said second bearing.

2. The means for providing lubrication of claim 1 further including:

said eccentric having a maximum radial position relative to said shaft;

said axially extending groove in said shaft being circumferentially displaced relative to said maximum radial position 90° to 270° in the direction of rotation of said shaft.

* * * * *